United States Patent [19]

Ragettli

[11] 4,352,281

[45] Oct. 5, 1982

[54] METHOD AND APPARATUS FOR BENDING PIPES

[76] Inventor: Christian Ragettli, Alstetterstrasse 149, 8048 Zurich, Switzerland

[21] Appl. No.: 201,590

[22] Filed: Oct. 28, 1980

[30] Foreign Application Priority Data

Oct. 31, 1979 [DE] Fed. Rep. of Germany ..... 2943960

[51] Int. Cl.[3] ..... B21D 7/08; B21D 7/14

[52] U.S. Cl. ..... 72/131; 72/133; 72/166; 72/369

[58] Field of Search ..... 29/157 A; 72/129, 131, 72/133, 166, 369, 402, 478

[56] References Cited

U.S. PATENT DOCUMENTS

| | | | |
|---|---|---|---|
| 1,891,338 | 12/1932 | Snell | 72/166 X |
| 1,908,373 | 5/1933 | Loepsinger | 72/166 X |
| 3,354,681 | 11/1967 | Lombard | 72/369 X |
| 4,031,733 | 6/1977 | Coody | 72/166 |

FOREIGN PATENT DOCUMENTS

| | | | |
|---|---|---|---|
| 530717 | 10/1976 | U.S.S.R. | 72/369 |

*Primary Examiner*—Ervin M. Combs
*Attorney, Agent, or Firm*—Abraham A. Saffitz

[57] ABSTRACT

A method and apparatus for bending straight pipe sections which are of predetermined length including cutting at a preset angle, bending, and calibrating to form a finished elbow.

8 Claims, 8 Drawing Figures

METHOD AND APPARATUS FOR BENDING PIPES

BACKGROUND OF THE INVENTION (1) Field of the Invention

The present invention relates to a method of bending straight pipe sections into pipe elbows and to an apparatus for performing this bending operation.

(2) Prior Art

Basically, two processes are currently used for making pipe elbows: the bending method and the welding method. In the bending process, a straight piece of pipe is clamped in a vise and formed into a bend after having been filled with a suitable filler and tightly sealed at both ends. This process has several disadvantages such as the high costs of a bending machine, the great forces which are to be used and the reduction in the wall strength of the pipe elbow at the outer curve of the bend. It is specifically this reduction in strength which adversely influences the load containing capacity of the entire pipe elbow and forces the manufacturer to select a far thicker pipe wall for the application than is actually required; as a result, much higher material costs are accepted simply to ensure that the critical outer wall of the pipe elbow is sufficiently strong at the end when the pipe is bent.

In the welding method, the starting point is a flat piece of sheet metal large enough to correspond to the development of the entire pipe elbow to be made. This piece of sheet metal is then suitably rolled up to form the shape of the pipe elbow and welded together. There are two main disadvantages: First, a significant part of the sheet metal is lost as waste and second, a significant mechanical effort is required for cutting, rollforming and welding the pipe elbow. Also, these are time consuming tasks.

OBJECT OF THE INVENTION

It is an object of the present invention to provide a process for making pipe elbows in which these disadvantages are eliminated to a great extent. In particular, an object of the invention is to provide a method of making pipe elbows economically, quickly and practically without material wastage while satisfying all requirements in terms of precise dimensions and uniform pressure withstand capacity.

A further object of the invention is to provide an apparatus for performing the process discussed herein by providing production equipment which is relatively simple, which consequently can be constructed at reasonable cost and which allows precise and fast forming.

SUMMARY OF THE INVENTION

The proposed method starts with a straight piece of pipe, which is to be formed into a pipe elbow. According to the invention, the method comprises the following steps: The piece of pipe is cut at an inclined plane to the pipe axis and then fed step by step into a shrinking device where it is shrunk. The shrunk section is then calibrated whereby the shrinking operation performed at an angle to the pipe axis and the calibration operation performed perpendicularly to the pipe axis are carried out simultaneously on consecutive pipe sections.

If 90° pipe elbows are to be produced—which is a frequent requirement in practical experience—both pipe ends must be cut at an angle of 38.146° to the normal axis plane. This ensures that the resulting pipe elbow will have flange planes exactly perpendicular to the pipe axis. It is quite remarkable that this cuttoff angle is entirely independent of the pipe diameter; it only depends on the type of pipe elbow. Thus a cutting device set up once may be used for processing pipes of various diameters for subsequent shrinking.

The shrinking process used in forming the bends requires far less force than conventional forming methods. It can also be proven mathematically that the moment generated in shrinking is much smaller than the moment generated in bending; this is obviously a great advantage in dimensioning the required equipment.

The apparatus for performing this method comprises according to the invention, a number of moveable shrinking and calibrating jaws and a pipe holding support and feeding device moving alongside an inclined plane toward the shrinking and calibrating jaws to hold and support one end of the pipe to be processed.

One preferred embodiment of such a pipe elbow forming apparatus is characterized by the provision of a number of shrinking and calibrating jaws which comprise segments arranged in a circle and fastened on segment support brackets in such manner that the segments may move radially towards each other.

To ensure that the shrinking and calibrating jaws can move towards each other simultaneously, the segment support brackets are connected with the device frame by means of pairs of joint levers and are controlled by piston-cylinder units.

In order to ensure that the segment support brackets can complete not only a lateral shifting movement but also a pivoting movement when the piston-cylinder units are operated, the joint levers of a pair are of unequal length. This lets one side of the segment supports where the shrinking sections of the shrinking and calibrating segments are located, travel a greater distance towards each other than the other sides of the segment supports where the calibrating sections of the segments are situated.

The tube holding support is provided with a carriage which can be displaced along an inclined plane relative to the shrinking and calibrating segments controlled by a piston-cylinder unit.

BRIEF DESCRIPTION OF THE DRAWINGS

The present invention will hereinafter be further described by way of example with reference to the accompanying drawings in which.

DESCRIPTION OF A PREFERRED EMBODIMENT

Figure 1:
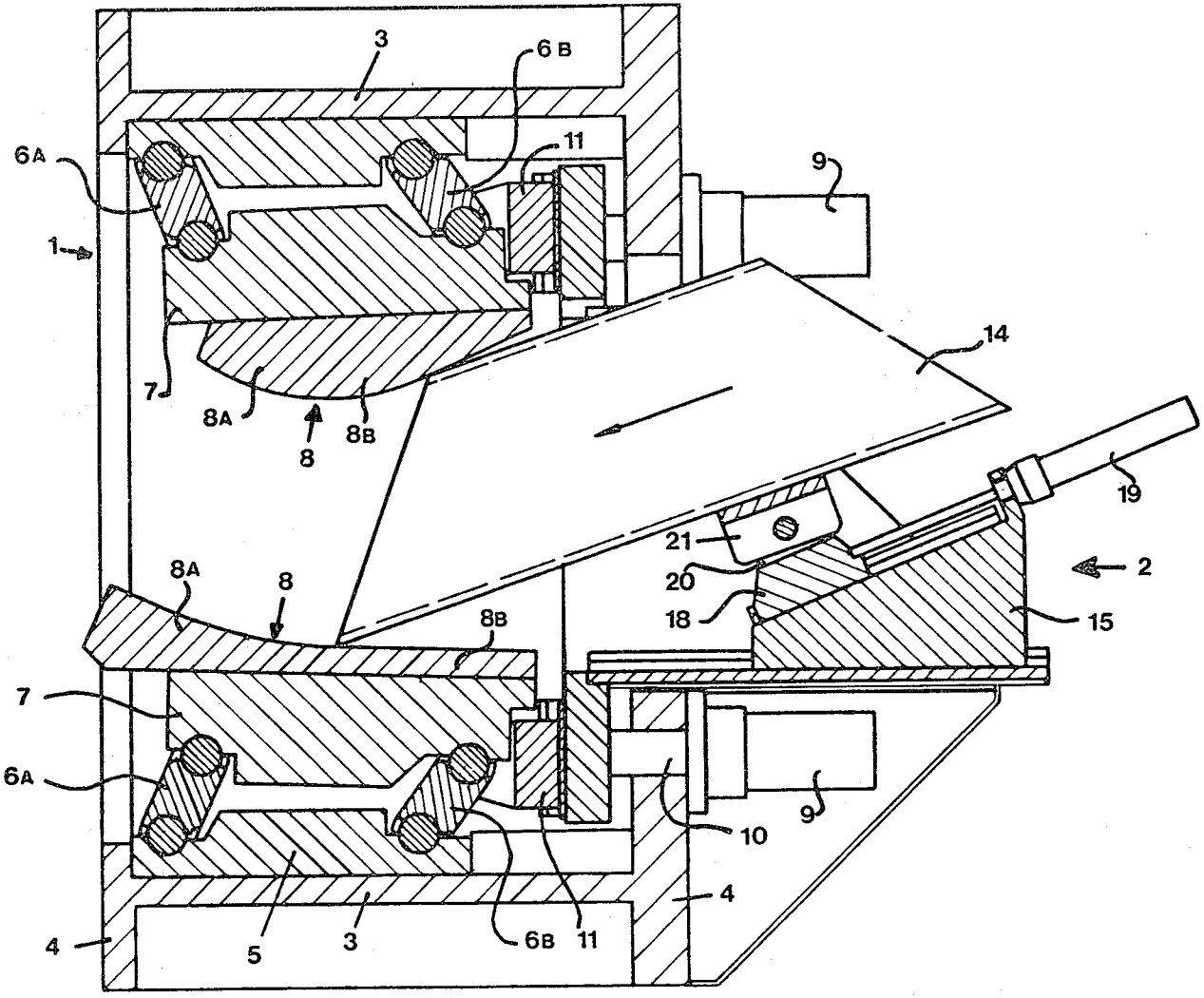
FIGS. 1 to 6 are schematic vertical longitudinal sectional views of the apparatus on different phases of processing a pipe elbow.
Figure 2:
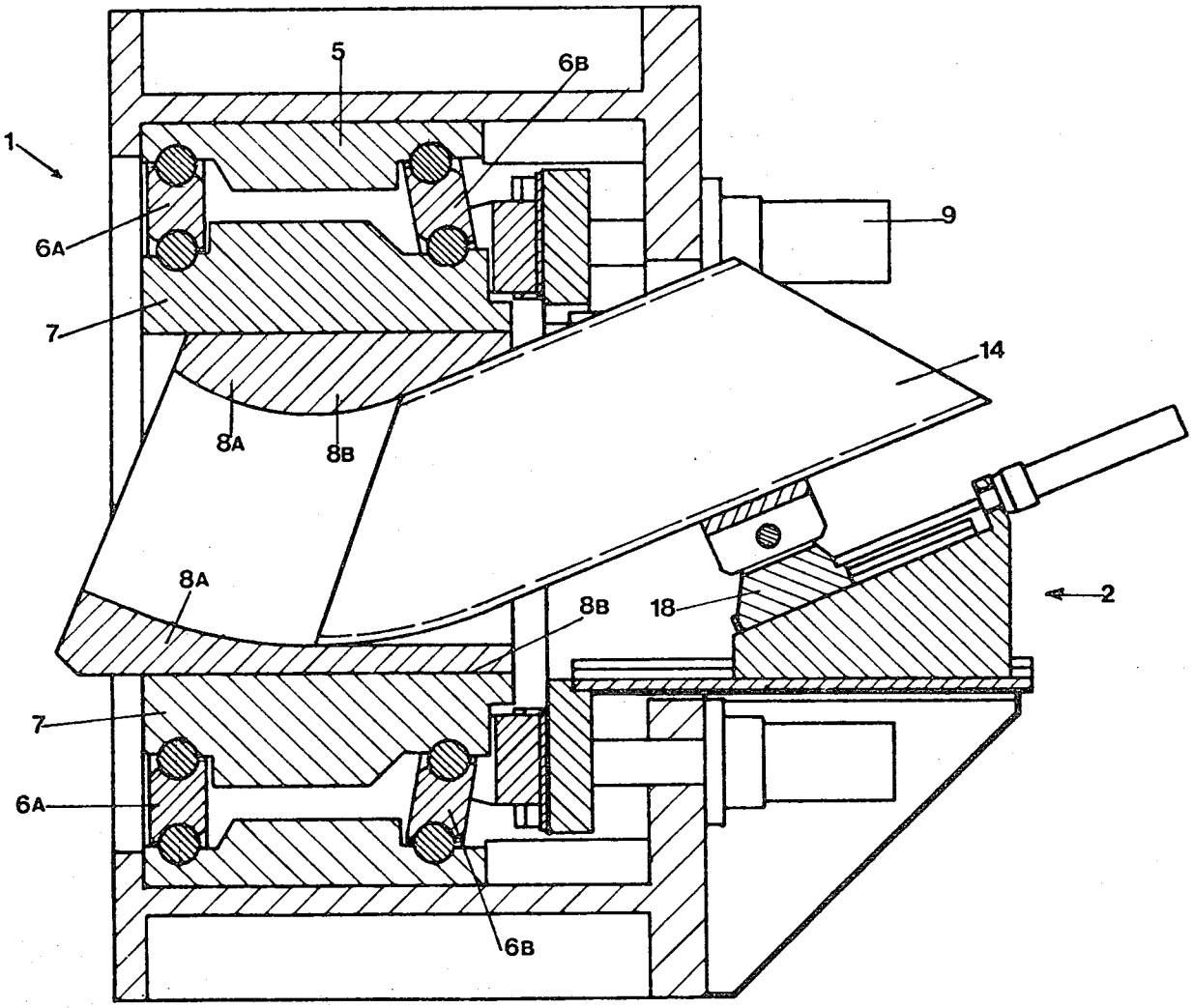
Figure 3:
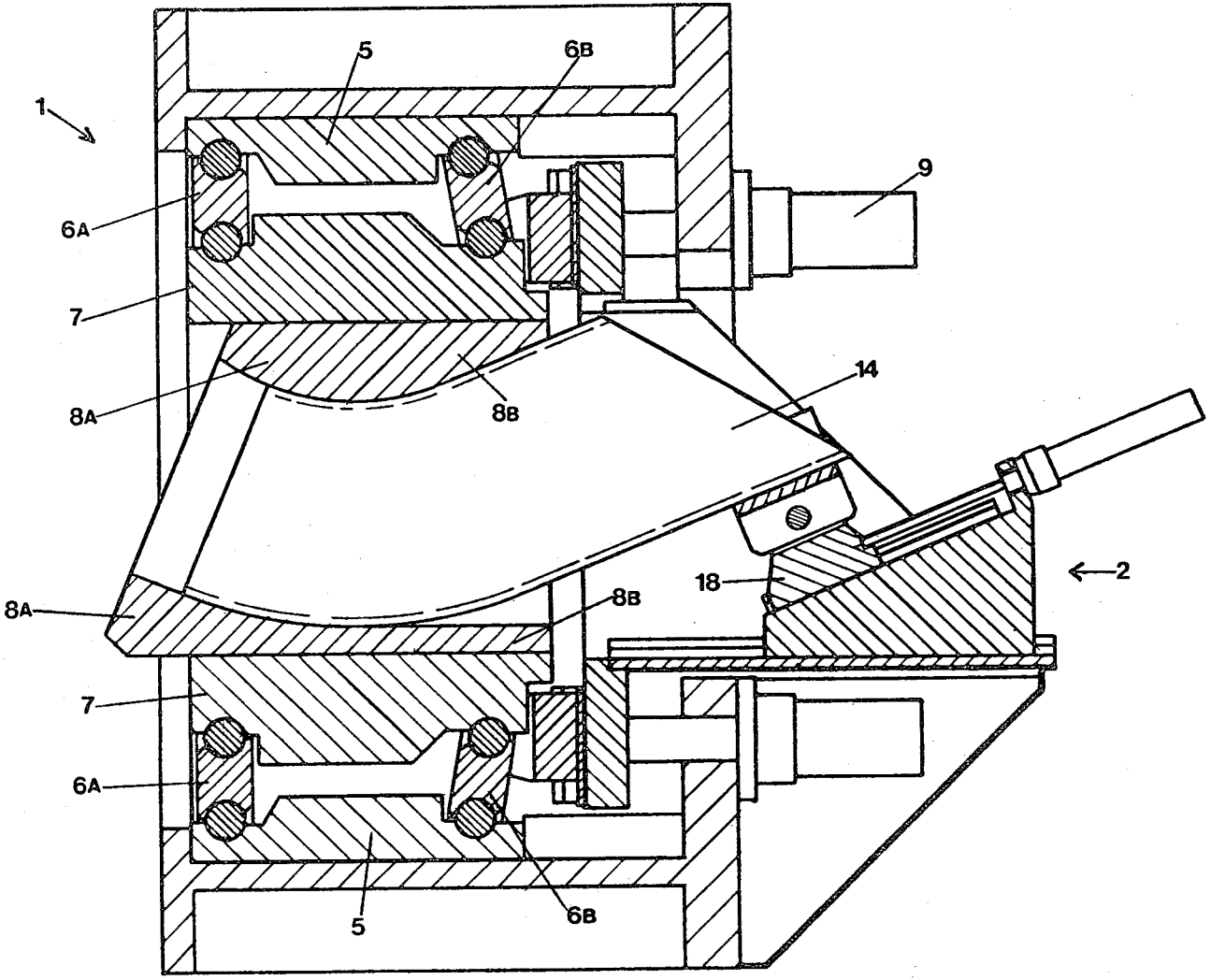
Figure 4:
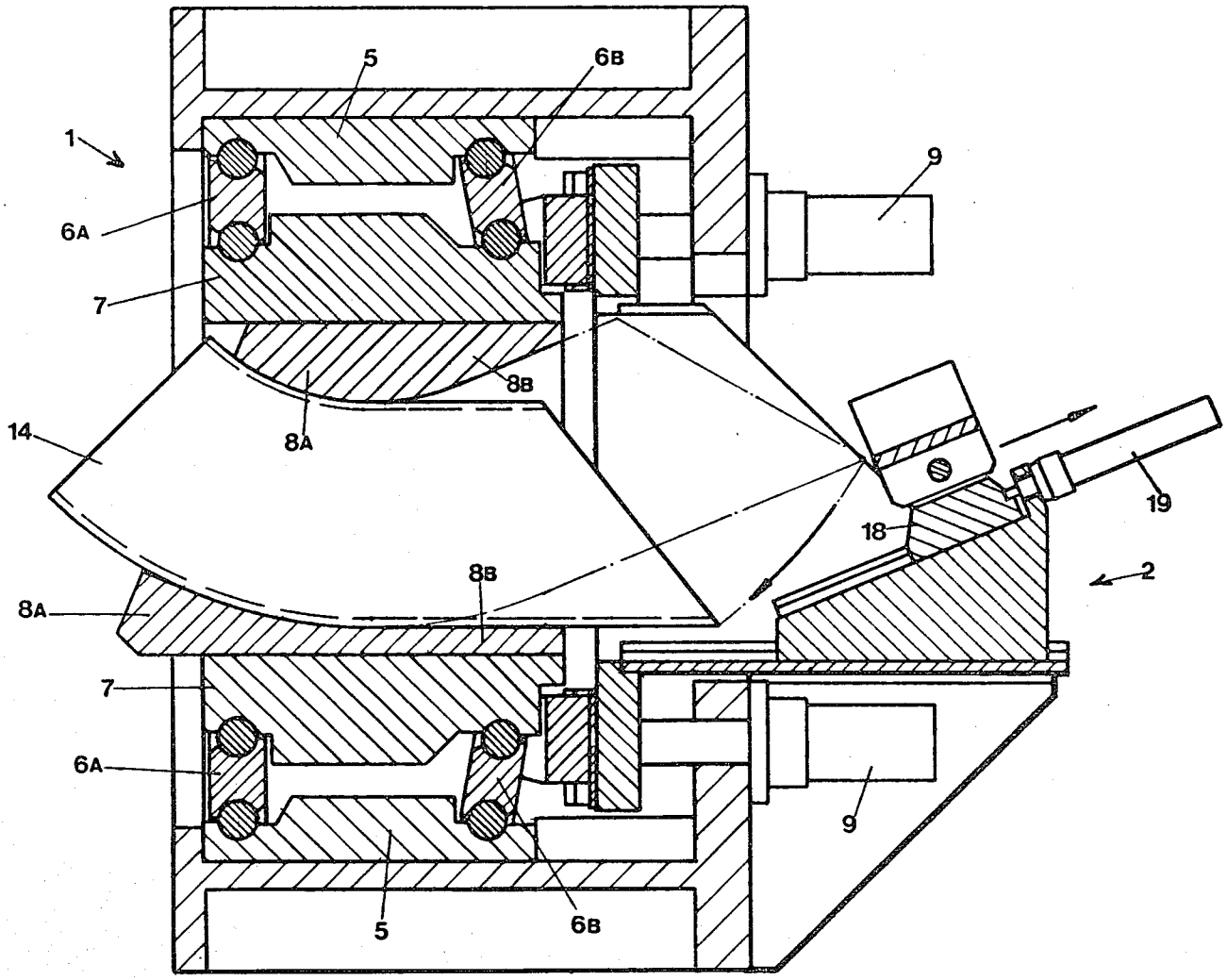
Figure 5:
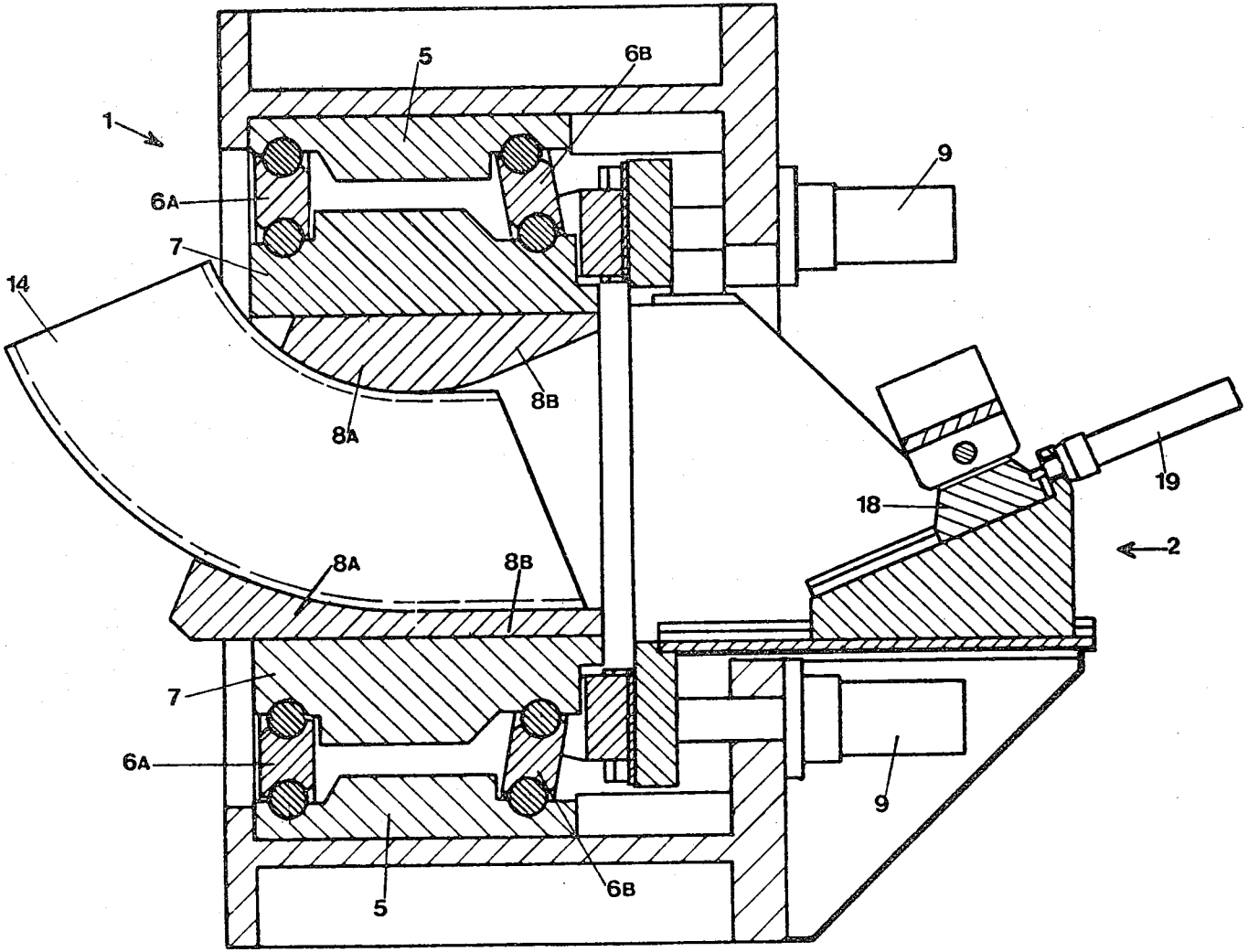

Basically, the apparatus comprises the actual shrinking and calibrating device 1 and the tube holder 2. The shrinking and calibrating system is provided with a frame 3 which is circular in its cross-section, and firmly fastened to the floor by means of a stand 4.

The interior of frame 3 is provided with a number of segment support anchors 5. The segment support brackets 7 are attached to the segment support anchors 5 by means of a pair of joint levers *6a*, *6b* so that they can pivot. The actual shrinking and calibrating segments 8 are located on the segment support brackets. Segments 8 are divided into two sections, a shrinking section 8*b* and a calibrating section 8*a*.

The segment support brackets are controlled by piston-cylinder units 9 which are situated at the front side of frame 3. Each piston-cylinder unit is allocated to one of the segment support brackets 7 and controls it via a piston rod 10 and an actuating member 11. It is easy to see that when the piston-cylinder units 9 are operated, the piston rods are shifted to the left which results in the pivoting action of the segment support brackets 7 as the latter are suspended by the pair of joint levers 6*a*, 6*b*. From this it follows that the segment support brackets 7 move closer to each other through their movement in the direction of the device center point.

As seen from FIGS. 1–6, levers 6*a* and 6*b* are not parallel and are not equally long. Levers 6*b* which are in the region of the shrinking sections 8*b* of the segments 8 are somewhat longer than levers 6*a* which are connected to brackets 7 in the region of the calibrating sections 8*a* of segments 8.

In the rest position of segments 8 shown in FIG. 1, all segment support brackets 7 are parallel and as a result the longer levers 6*b* are pivoted further than the shorter levers. As soon as the piston-cylinder units 9 are operated and segment support brackets 7 are shifted in the direction of the device center point, the brackets will not move parallel to the center but that end of the segment support brackets 7 which is in the region of the shrinking section 8*b* of segments 8 will travel along a longer path than the end in the region of calibrating section 8*a* of segments 8.

The shrinking and calibrating segments 8 are easily replaceable to adapt the shrinking and calibrating device to different tube diameters.

Figure 7:
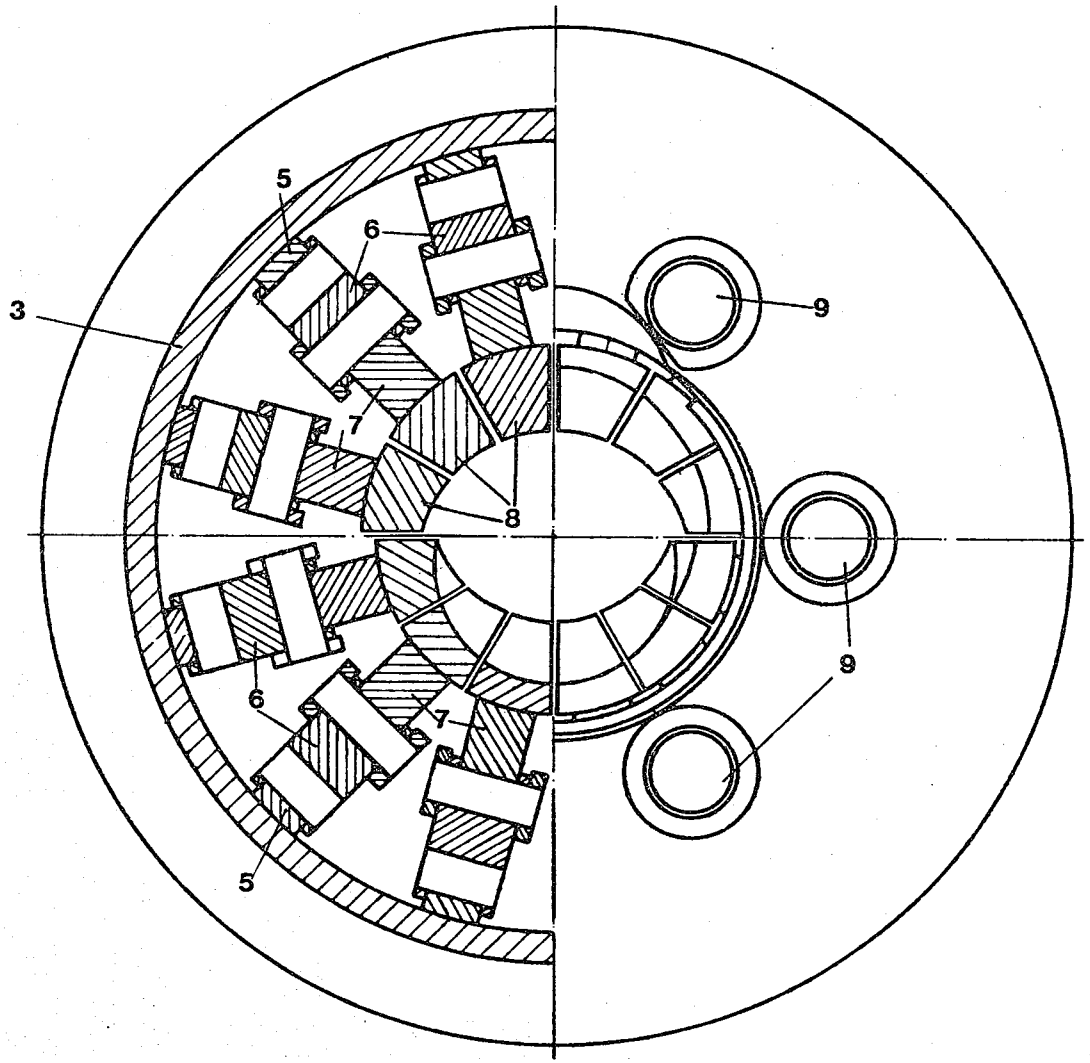
FIG. 7 is a cross section along the lines A—A in FIG. 1.

As shown in FIG. 7, the majority of shrinking and calibrating segments 8 (in the example given there are twelve) are arranged radially along a circle. In their fully extended position, they are densely arranged side by side so that the calibrating sections 8*a* encircle a surface with their internal faces which corresponds to the external suface of the pipe bend to be formed.

Furthermore, as shown in FIGS. 1–6, the pipe holding and feeding mechanism comprises a base part 15 whose surface is constructed in the manner of a plane sloping in the direction of the shrinking device 1 and is supported by a carriage 18 and can move back and forth.

A hydraulic or pneumatic piston-cylinder unit 19 is provided to operate carriage 18.

Carriage 18 is equipped with an extension 20 to which a pivotable pipe support element 21 ist mounted. The function of the pipe support element 20 is to support the pipe section 14 to be processed.

Figure 8:
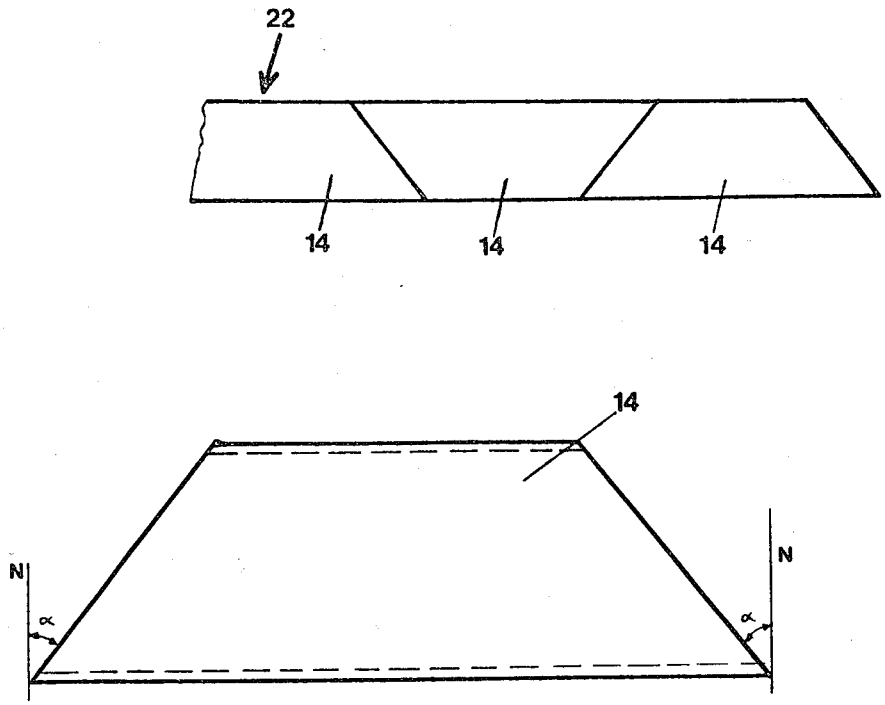
FIG. 8 is a schematic view of pipe sections prior to processing.

The process of making a pipe elbow is performed as follows:

As seen in FIG. 8, a long pipe 22 ist cut into suitable pipe sections 14 to be processed. Both ends of the individual sections are cut at an angle so that the finished pipe elbows have flange surfaces that are already perpendicular to the tube axis.

It can be proved mathematically that there is a specific cutoff angle for a given pipe regardless of the pipe diameter. For instance, for a 90° pipe elbow, the cut-off angle of the pipe section must be 38.146° to the normal axis plane of the pipe. For a 45° pipe bend, the cutoff angle ist 21.44°. These calculations allow suitable pipe lengths to be cut from a long piece pratically without any waste as shown in FIG. 8.

The next step is to position the prepared pipe section on pipe support element 21 of carriage 18 and to feed it towards the shrinking and calibrating device 1 until the pipe edges contact the shrinking sections 8*b* of segments 8. This situation is shown in FIG. 1. Subsequently, the piston-cylinder units 9 are operated and bring all segments 8 together; they deform the pipe section 14 in a controlled manner. As shown in the drawing, this shrinking operation is not perpendicular to the pipe axis but takes place at a certain angle which is less than 90°. Thus, the cross section of the pipe which is elliptical when viewed in the shrinking axis is gradually deformed into a circle.

As soon as segments 8 reach their fully extended position, the piston-cylinder units are operated in the opposite direction with the result that segments 8 are withdrawn. This is followed by a pipe feed cycle. Pipe section 14 is pressed further in the direction of device 1 until the pipe edge again contacts segments 8. Segments 8 are once again extended in order to shrink the next of pipe section 14.

These sequences are repeated step by step whereby a starting section of pipe 14 is formed into a pipe elbow. The situation illustrated in FIG. 2 has now been reached.

Up to this point of the process, only a shrinking operation has been performed on pipe section 14 with shrinking sections 8*b* of segments 8. The next processing stage involves calibration of the shrunk leading part of pipe section 14 under the effect of calibrating sections 8*a* of segments 8 which will deform the pipe bend into its final shape with regard to angle and roundness.

For this purpose, segments 8 are pulled back again; pipe section 14 is advanced and the piston-cylinder units 9 are operated so that segments 8 are closed again. The previously shrunk leading part of pipe section 14 on the one hand is calibrated by the calibrating sections 8*a* while on the other hand the subsequent pipe sections are shrunk by the shrinking sections 8*b* of segments 8. This is performed exactly as already described while pipe section 14 is gradually being fed into device while the segments alternately advance and retract. This is the situation illustrated in FIG. 3.

As described in the design description of the device, levers 6*b* are longer than levers 6*a* so that upon operation of segments 8, the sections 8*b* travel along a longer path than sections 8*a*. The reason for this is that the shrinking process is to be performed with less force over a longer path than the calibrating process in which large forces are required over a shorter path. The invention satisfies these requirements with a strikingly simple technical solution.

After half the pipe elbow is formed (FIG. 3), the end of pipe section 14 is taken from the pipe support element 21 and carriage 18 is retracted by means of the piston-cylinder unit so that the pipe section can be pivoted downward to a certain extent corresponding to 22.5° (FIG. 4) for a 90° pipe elbow.

Figure 6:
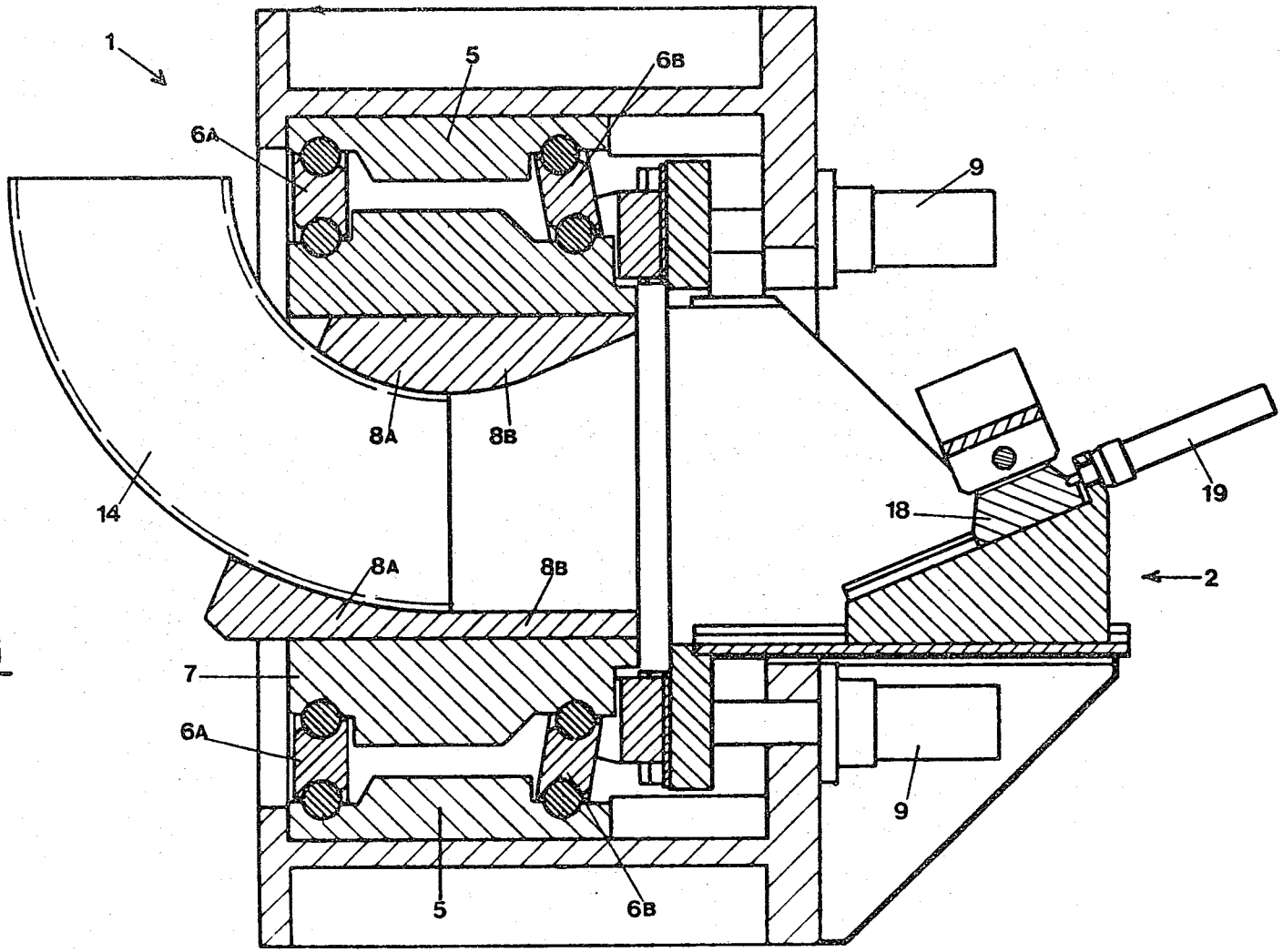

The remaining pipe sections are then processed in exactly the same manner by shrinking and calibrating (FIG. 5) until the situation illustrated in FIG. 6 is achieved whereby the last shrunk part of pipe section 14 is calibrated by means of segment sections 8*a*. With this operation, the processing sequences involving pipe section 14 are completed, segments 8 can back off and the finished pipe elbow can be removed from device 1.

The process using the suggested method and equipment is extremely efficient and the required equipment is simple and rugged. It is not necessary to use a calibrating plug for the inside of the pipe. Nevertheless, the pipe elbows formed in the above manner are perfectly round and have uniform wall thicknesses.

What I claim is:

1. A method of mechanically bending straight pipe sections into elbows having a predetermined length and angle comprising the steps of:

measuring the length of the straight pipe sections to make the sections correspond to the pre-determined length of a finished elbow;

cutting the straight pipe ends at an angle to the center axis of the pipe which angle will determine and assure that a planar face of a flange which is to be fitted to the ends of a finished elbow elbow will be perpendicular to the axis of the tube, the angle being 38.146° for a 90° elbow, 21.440° for a 45° elbow, and less than 21° for less than a 45° elbow;

feeding said straight pipe sections after measuring and cutting into a pressing and calibration station wherein pressing is performed mechanically on successive step portions of said pipe by means of a plurality of processing segments arranged radially along a circle in equidistant positions with the pressing ends of said segments bearing inwardly against said pipe in two pressing stages, the first pressing stage being carried out in the absence of calibrating to provide a plurality elliptically shaped cross sections and then in a second pressing stage with simultaneous pressing and calibration to convert the elliptically shaped cross sections into a round cross section to shorten the elliptical axis and thereby shrink the pipe;

simultaneously calibrating the portions of said pipe being bent during pressing in said second stage which requires the successive pressing of step portions on the elliptical cross sections formed in the first pressing stage controlling the pressing in said second stage by means of a calibrating means forming part of said inwardly pressing segments, the contour of said calibrating means fitting the final shape of the elbow with respect to roundness and angle;

said second mechanical pressing by inward pressing of said pressing segment being carried out at an angle of less than 90° to the center axis of said pipe;

said calibrating step being carried out at an angle which is perpendicular to the center axis of said pipe whereby the final pressing deformation of said section with respect to angle of the elbow and roundness is carried out only during said calibration step;

and said first mechanical pressing steps being carried out at an angle less than 90° relative to the center axis of the pipe, thus converting said straight pipe into an elliptical shape without retraction of said pressing segment while said pressing and calibrating steps alter said elliptical shape into a round shape with retraction of said pressing segments.

2. Apparatus for bending straight pipe sections into pipe elbows having a predetermined length and angle comprising:

means for measuring the straight pipe sections to make the sections correspond to the predetermined length of a finished elbow;

cutting means to cut the straight pipe ends at an angle to the center axis of the pipe, which angle will determine and assure that a planar face of a flange which is to be fitted to the ends of a finished elbow will be perpendicular to the axis of the tube, the angle being 38.146° for a 90° elbow, 21.440° for a 45° elbow, and less than 21° for less than a 45° elbow;

carriage means for supporting said cut pipe sections and for feeding said sections into a pressing station and into a calibrating station along an inclined plane in a direction of successive mechanical pressing of the pipe in a first pressing stage to an ellipse and in a second pressing stage to a circle cross section;

first deforming means operated by hydraulic piston-cylinder units and levers in said first pressing station where the elliptical cross section is formed;

a plurality of inwardly pressing arcuately shaped segments arranged radially along a circle in equidistant positions with pressing ends of said segments bearing inwardly against said pipe operated by said first deforming means;

a second deforming means;

a calibrating means positioned beyond said first deforming means, the contour of said calibrating means conforming to the final shape of the elbow formed by said second deforming means with respect to roundness and angle;

said second deforming means having a plurality of inwardly pressing elements;

said inwardly pressing elements of said first deforming means being pressed against said pipe at an angle of less than 90° to the center axis of the pipe;

said calibrating means being operated at an angle which is perpendicular to the axis of said pipe whereby the final deformation of said section with respect to the angle and roundness of the elbow is carried out;

the first pressing by said first deforming means being carried out at an angle less than 90° converting said straight pipe into an elliptical shape while said second pressing step after alters said elliptical shape into a round shape; and said calibrating means holding and supporting one end of said pipe while it is mechanically shaped and calibrated to complete said elbow before the carriage moves to discharge said pipe.

3. An apparatus as claimed in claim 2 wherein said segments are each fastened to brackets to permit radial movement of each segment toward the other.

4. An apparatus as claimed in claim 3 in which said bracket is connected to the carriage and carriage support by joint lever pairs and said joint lever pairs are actuated by hydraulic piston-cylinder units.

5. An apparatus as claimed in claim 4 in which the joint levers for a given pair of segments are of unequal length thereby providing pivoting movement of the segment support bracket and simultaneous lateral shift during the operation of said piston-cylinder unit.

6. An apparatus as claimed in claim 5 wherein the elliptical shape after the first pressing is connected into a round shape in a shrinking section which precedes the calibration section.

7. An apparatus as claimed in claim 6 wherein the levers in the shrinking section are longer than the levers in the calibrating section whereby the straight tube travels a greater distance in the shrinking section than in the calibrating section.

8. An apparatus as claimed in claim 7 wherein the carriage is shifted in either direction along the inclined plane by means of a piston-cylinder unit.

* * * * *